US008555789B2

(12) United States Patent
Jin et al.

(10) Patent No.: US 8,555,789 B2
(45) Date of Patent: Oct. 15, 2013

(54) FRAME FOR A FOLDING TABLE

(75) Inventors: Ju-Young Jin, Xiamen (CN); Cai Yixian, Shishi (CN); Mitch Johnson, South Weber, UT (US)

(73) Assignee: Lifetime Products, Inc., Clearfield, UT (US)

( * ) Notice: Subject to any disclaimer, the term of this patent is extended or adjusted under 35 U.S.C. 154(b) by 0 days.

(21) Appl. No.: 13/559,062

(22) Filed: Jul. 26, 2012

(65) Prior Publication Data

US 2013/0025507 A1 Jan. 31, 2013

Related U.S. Application Data

(60) Provisional application No. 61/513,422, filed on Jul. 29, 2011.

(51) Int. Cl.
*A47B 3/00* (2006.01)

(52) U.S. Cl.
USPC ..... 108/129; 109/91; 109/132

(58) Field of Classification Search
USPC ..... 108/166, 167, 168, 169, 170, 171, 172, 108/173, 174, 175, 91, 53.3, 115, 132, 129, 108/130, 131, 99; 248/188.1, 188.6
See application file for complete search history.

(56) References Cited

U.S. PATENT DOCUMENTS 1,593,975 A 7/1926 Karstens
1,856,935 A 5/1932 Turner
2,889,185 A * 6/1959 Heisler ..... 108/91
3,389,511 A * 6/1968 Drehobl ..... 108/91
3,917,108 A 11/1975 Thurman
4,570,993 A 2/1986 Widerker
4,841,877 A * 6/1989 Virtue ..... 108/36
5,381,740 A * 1/1995 Johnston ..... 108/167
5,421,272 A 6/1995 Wilmore
5,505,142 A 4/1996 Fink
5,664,934 A 9/1997 Schaede et al.
5,775,655 A 7/1998 Schmeets
5,960,720 A 10/1999 Borland et al.
5,983,807 A 11/1999 Tarnay et al.
6,058,853 A 5/2000 Pinch
6,112,674 A 9/2000 Stanford
6,199,487 B1 * 3/2001 Coddington ..... 108/56.1
6,394,004 B1 5/2002 Lynn (Continued)

OTHER PUBLICATIONS

International Search Report and Written Opinion dated Oct. 15, 2012 from PCT International Application No. PCT/US2012/048485.

(Continued)

*Primary Examiner* — Jose V Chen
(74) *Attorney, Agent, or Firm* — Maschoff Brennan

(57) ABSTRACT

A foldable table may include a table top and legs movable between an extended position and a collapsed position. A first portion of a side rail may be connected to a first table top section and a second portion of the first side rail may be connected to a second table top section. An engaging portion of the first portion of the side rail may be at least partially disposed in a receiving portion of the second portion of the side rail when the table top is in the folded position and an engaging portion of the second portion of the side rail may be at least partially disposed in a receiving portion of the first portion of the side rail when the table top is in the folded position.

20 Claims, 9 Drawing Sheets

(56) References Cited

U.S. PATENT DOCUMENTS

| | | | | |
|---|---|---|---|---|
| 6,722,293 | B2 | 4/2004 | Lee | |
| 6,732,663 | B2 | 5/2004 | Tsai | |
| 6,752,091 | B2 * | 6/2004 | Glover et al. | 108/168 |
| 6,772,700 | B2 | 8/2004 | Wong | |
| 7,069,865 | B2 | 7/2006 | Strong et al. | |
| 7,073,450 | B2 * | 7/2006 | Tsai | 108/132 |
| 7,096,800 | B2 | 8/2006 | Stanford | |
| 7,100,518 | B2 | 9/2006 | Strong | |
| 7,111,563 | B2 | 9/2006 | Strong | |
| 7,150,237 | B2 | 12/2006 | Lin et al. | |
| 7,171,910 | B2 | 2/2007 | Neunzert et al. | |
| 7,278,361 | B2 * | 10/2007 | Zhurong et al. | 108/168 |
| 7,428,872 | B2 | 9/2008 | Strong et al. | |
| 7,634,969 | B2 | 12/2009 | Neunzert et al. | |
| 7,640,870 | B2 | 1/2010 | Strong et al. | |
| 7,707,947 | B2 | 5/2010 | Winter et al. | |
| 7,752,982 | B2 * | 7/2010 | Lin | 108/168 |
| 7,799,482 | B2 * | 9/2010 | Cho et al. | 108/91 |
| 7,905,185 | B2 | 3/2011 | Peery et al. | |
| 8,006,630 | B2 | 8/2011 | Strong et al. | |
| 8,033,228 | B2 | 10/2011 | Haney | |
| 8,042,476 | B2 | 10/2011 | Stanford | |
| 8,074,582 | B2 | 12/2011 | Stanford | |
| 8,091,289 | B2 | 1/2012 | Mower et al. | |
| 8,161,711 | B2 | 4/2012 | Steed et al. | |
| D662,738 | S | 7/2012 | Winter et al. | |
| 8,267,018 | B2 * | 9/2012 | Gunn | 108/53.1 |
| 8,347,795 | B2 | 1/2013 | Peery et al. | |
| 8,397,652 | B2 | 3/2013 | Peery et al. | |
| 8,408,146 | B2 | 4/2013 | Peery et al. | |
| 2003/0167981 | A1 | 9/2003 | Cai et al. | |
| 2003/0221595 | A1 * | 12/2003 | Reinsch et al. | 108/91 |
| 2003/0233968 | A1 | 12/2003 | Strong et al. | |
| 2005/0005826 | A1 | 1/2005 | Strong et al. | |
| 2005/0045074 | A1 | 3/2005 | Jin | |
| 2005/0098068 | A1 | 5/2005 | Tsai | |
| 2005/0155531 | A1 | 7/2005 | Chang | |
| 2005/0268827 | A1 | 12/2005 | Stanford | |
| 2006/0019776 | A1 | 1/2006 | Mower | |
| 2006/0230989 | A1 | 10/2006 | Haney et al. | |
| 2007/0101910 | A1 | 5/2007 | Haimoff et al. | |
| 2007/0199483 | A1 | 8/2007 | Peery et al. | |
| 2007/0272128 | A1 | 11/2007 | Lin | |
| 2008/0060563 | A1 | 3/2008 | Yang | |
| 2009/0114131 | A1 | 5/2009 | Haney et al. | |
| 2012/0266790 | A1 * | 10/2012 | Peery et al. | 108/91 |

OTHER PUBLICATIONS

U.S. Appl. No. 13/455,041, filed Apr. 24, 2012, Peery, et al.
U.S. Appl. No. 13/455,055, filed Apr. 24, 2012, Peery, et al.
U.S. Appl. No. 13/455,066, filed Apr. 24, 2012, Peery, et al.
U.S. Appl. No. 13/455,073, filed Apr. 24, 2012, Peery, et al.
U.S. Appl. No. 13/455,076, filed Apr. 24, 2012, Peery, et al.
U.S. Appl. No. 13/455,081, filed Apr. 24, 2012, Peery, et al.
U.S. Appl. No. 13/592,230, filed Aug. 22, 2012, Peery, et al.
U.S. Appl. No. 13/604,557, filed Sep. 5, 2012, Peery, et al.
Office Action from U.S. Appl. No. 13/455,041 dated Jun. 27, 2012.
Office Action from U.S. Appl. No. 13/455,055 dated Jun. 27, 2012.
Office Action from U.S. Appl. No. 13/455,076 dated Sep. 4, 2012.
Office Action from U.S. Appl. No. 13/455,081 dated Sep. 11, 2012.
Office Action from U.S. Appl. No. 13/592,230 dated Nov. 6, 2012.
Office Action from U.S. Appl. No. 13/604,557 dated Dec. 20, 2012.
Notice of Allowance from U.S. Appl. No. 13/455,041 dated Sep. 10, 2012.
Notice of Allowance from U.S. Appl. No. 13/455,055 dated Oct. 17, 2012.
Notice of Allowance from U.S. Appl. No. 13/455,066 dated Sep. 10, 2012.
European Search Report from EPO Application No. EP12183082 dated Nov. 20, 2012.
International Search Report and Written Opinion from PCT/US2012/035058 dated Jul. 13, 2012.
International Search Report and Written Opinion from PCT/US2012/035054 dated Jul. 17, 2012.
International Search Report and Written Opinion from PCT/US2012/035055 dated Jul. 17, 2012.
International Search Report and Written Opinion from PCT/US2012/035056 dated Jul. 17, 2012.
International Search Report and Written Opinion from PCT/US2012/035059 dated Jul. 17, 2012.
International Search Report and Written Opinion from PCT/US2012/035061 dated Jul. 17, 2012.
U.S. Appl. No. 13/735,913, filed Jan. 7, 2013, Peery et al.
U.S. Appl. No. 13/846,648, filed Mar. 18, 2013, Peery et al.
Office Action from U.S. Appl. No. 13/455,073 dated Feb. 28, 2013.
Office Action from U.S. Appl. No. 13/455,076 dated May 13, 2013.
Notice of Allowance from U.S. Appl. No. 13/604,557 dated Jul. 12, 2013.

* cited by examiner

FRAME FOR A FOLDING TABLE

CROSS-REFERENCE TO RELATED APPLICATIONS

The present invention claims priority to and the benefit of U.S. Provisional Patent Application Ser. No. 61/513,422, entitled "Frame for a Folding Table," which was filed on Jul. 29, 2011, and is hereby incorporated by reference in its entirety.

BACKGROUND OF THE INVENTION

1. Field of the Invention

The present invention generally relates to furniture and, in particular, to tables that are capable of being folded and unfolded.

2. Description of Related Art

Many different types of tables are well known and used for a variety of different purposes. For example, conventional tables may include legs that are pivotally attached to a table top and the legs may be movable between a use position in which the legs extend outwardly from the table top and a storage position in which the legs are folded against an underneath portion of the table top. Conventional tables with relatively large table tops and folding legs are often referred to as "banquet tables" and these tables are frequently used in assembly halls, banquet halls, convention centers, hotels, schools, churches and other locations where large groups of people meet. When the tables are no longer needed, the table legs can be moved into the storage position and the tables may be moved or stored.

Conventional banquet tables with movable legs may allow the table to be more conveniently stored. The table top for many conventional banquet tables with movable legs, however, retains its size and shape. For example, many known banquet tables have a length between six and ten feet and a width between three and four feet. As a result, many conventional banquet tables require a large storage area even when the legs are in the collapsed position. This large storage area may be especially problematic for larger facilities such as hotels, schools and churches because a considerable number of tables may have to be stored. Thus, a significant amount of space may be required to store the tables. In addition, smaller facilities such as restaurants, offices and homes may use one or more conventional banquet tables. These smaller facilities may use the tables less frequently, such as during special occasions. Conventional banquet tables, even when the legs are folded, are often too bulky and awkward to be conveniently used and stored at such smaller facilities. As a result, it is often necessary for both larger and smaller facilities to rent and/or borrow banquet tables when needed. Disadvantageously, this process of renting and/or borrowing banquet tables can be inconvenient, time consuming and costly.

Conventional banquet tables are also often difficult to move or transport from one location to another. For example, because of the length of many conventional banquet tables, it is often difficult for a single person to move the table. In addition, the extended length of conventional banquet tables may preclude the tables from being transported in the trunk or back seat of a typical passenger car. Accordingly, conventional banquet tables may have to be transported by a truck, trailer or oversized vehicle such as a sports utility vehicle. These and other factors may make conventional banquet tables difficult, time consuming and expensive to move.

It is also known to construct tables that are capable of being folded in half. In particular, conventional fold-in-half tables include a table top with two sections pivotally connected by hinges. The two sections usually have the same size and shape, and the hinges are typically located at the center or middle of the table top. The two sections of the table top may be moved between an unfolded position in which the sections of the table top are generally aligned in the same plane and a folded position in which the two sections are positioned generally adjacent to each other for storage.

Disadvantageously, many conventional fold-in-half tables with foldable table tops are unable to support a significant amount of weight. For example, the connection between the two sections of the table top for many known fold-in-half tables is relatively weak, which may cause, for example, a portion of the table top to sag or slump. Additionally, the connection between the table top sections for many known fold-in-half tables may be relatively frail and may break if a significant load or force is applied to the table top. In order to construct a stronger table, it is known to increase the size and thickness of the frame, but this may undesirably increase the weight and cost of the table. Further, many conventional fold-in-half tables require a large amount of space even when the table is folded, which may make the tables awkward or difficult to move. The large size may also limit the number of fold-in-half tables that can be stored in a given area.

BRIEF SUMMARY OF EMBODIMENTS OF THE INVENTION

A need therefore exists for a table that eliminates or diminishes the disadvantages and problems described above.

One aspect is a table that may include a table top and one or more support structures or legs that may be used to support the table top in a use position. The support structures may be movable between an extended or use position and a collapsed or storage position relative to the table top. When the support structures are in the use position, the support structures may extend outwardly and away from the table top. When the support structures are in the collapsed position, the support structures may be disposed generally parallel and at least proximate a lower or underneath portion of the table top. At least a portion of the support structures may contact or abut the lower portion of the table top when the support structures are in the collapsed position. Advantageously, when the support structures are in the use position, the table may be used to support a wide variety of objects and the table may be used for many different purposes. When the support structures are in the collapsed position, the table may be more easily moved, stored and/or transported.

Another aspect is a table that may include a table top capable of being folded and unfolded. For example, the table top may include two sections generally aligned in the same plane when the table top is in the unfolded position. The two sections of the table top may be generally positioned parallel and adjacent to each other when the table top is in the folded position. The table may also include support structures movable between use and collapsed positions. Advantageously, if the table includes both a foldable table top and support structures that can be moved between the use and collapsed positions, the table may be stored in a relatively compact area. This may also allow, for example, a single person to easily move and transport the table. In addition, this may allow the table to be positioned in a relatively small area, such as the backseat or trunk of an automobile. Further, this may allow one or more tables to be shipped and/or stored in relatively small areas, which may allow transportation and storage costs to be decreased.

Still another aspect is a table that may include a table top constructed from plastic and the plastic table top may be constructed using a blow-molding process. Advantageously, the blow-molded plastic table top may be lightweight, easily constructed and formed into a desired shape, size, configuration and design. The blow-molded plastic table top may also be generally weather resistant and temperature insensitive, which may allow the table to be used in a wide variety of locations and environments. In addition, the blow-molded plastic table top may be durable, long-lasting and corrosion resistant. Further, the blow-molded plastic table top may be relatively strong and used to support a relatively large amount of weight. Significantly, the blow-molded plastic table top may form a structural member of the table and various features may be integrally formed in the table top as part of a unitary, one-piece construction.

Advantageously, a blow-molded plastic table top may be relatively strong because it may include opposing walls or surfaces separated by a distance. In particular, the opposing walls may be separated by a generally constant distance and the table top may have generally uniform characteristics and features, which may help create a table top with generally uniform properties such as strength and structural integrity. In addition, because a hollow interior portion may be formed during the blow-molding process, that may facilitate construction of a lightweight table top. Thus, the blow-molded plastic table top may be both lightweight and strong. The table top could also be formed from other suitable processes, such as injection, rotational, extrusion, vacuum or thermoforming processes, and the table top could be constructed using other appropriate materials such as steel, aluminum, composites and the like.

Yet another aspect is a table that may include a frame attached to the table top. The frame may be sized and configured to allow the table top to be moved between the folded and unfolded positions. For example, the frame may include rails, such as side rails, connected to the first and second sections of the table top and the side rails may be pivotally connected by one or more hinge assemblies. In particular, a first portion of the side rail may be connected to the first section of the table top and a second portion of the side rail may be connected to the second section of the table top. The hinge assembly may be connected to the first and second portions of the side rail, which may allow a strong and sturdy table top to be constructed.

A further aspect is a table that may include a frame with nesting, interlocking and/or overlapping portions when the table is in the folded position, which may allow the height of the frame to be significantly decreased in the folded position while maintaining the same strength and structural integrity as a conventional frame with a similar size and configuration. For example, the frame may include an elongated member or rail and a first portion may be connected to a first portion of a table top and a second portion may be connected to a second portion of the table top. The rail may include one or more receiving and/or engaging portions in which an engaging portion is sized and configured to be disposed in a receiving portion when the table is in the folded position. For instance, the first portion of the rail may include a receiving portion and the second portion of the rail may include an engaging portion, and the engaging and receiving portions may be sized and configured to interact when the frame is in the folded position. In particular, the engaging portion may be disposed in the receiving portion, which may decrease the height of the frame in the folded position.

A still further aspect is a table that may include a frame with a generally L-shaped configuration. The upper portion of the generally L-shaped portion of the frame may form the engaging portion and the notch or cutout may form the receiving portion. This may allow, for example, the frame to include first and second portions that are mirror-images of one another. The frame could also include first and second generally L-shaped portions that are connected to the table top in inverted and/or opposing configurations, which may allow the engaging portion to be disposed in the receiving portion when the frame is in the folded position.

Yet another further aspect is a folding table that may be disposed in a more compact configuration in the collapsed position than a conventional folding table. For example, because the strength and rigidity of a table may be directly proportional to the height and width of the side rails of the frame, decreasing the height and/or width of the side rails may undesirably decrease the strength and/or rigidity of the table. Therefore, it may be desirable to maintain the height and width of the side rails so that the frame of the more compact folding table has the same general size, strength and other characteristics as the frame of a conventional folding table. Additionally, if the size of the side rails is decreased, then consumers and retailers may assume the table has less strength and rigidity than a comparable conventional folding table. For these and other reasons, the frame of the more compact folding table may have substantially the same height and width as a conventional folding if factors such as cost, size and strength are desired to stay generally the same. The frame for a conventional folding table has a thickness at least twice the height of the side rails in the folded position. Therefore, conventional tables in the collapsed position have a thickness equal to the combined height of the first section of the table top, the first portion of the side rail, the second portion of the side rail and the second section of the table top. The folding table disclosed herein, however, may have generally the same strength, rigidity and other characteristics as a conventional table because the height and width of the side rails may be relatively unchanged, but the table may be disposed in a more compact configuration because the side rails may include one or more receiving and engaging portions. This may advantageously allow the table to have a decreased overall height or thickness in the folded position because a portion of the side rails may overlap or be nested together.

Still yet another further aspect is a table that may be more efficiently packaged, stored and/or transported. For example, incorporating one or more of the above-described features may advantageously allow about 1,200 tables to be stored in a standard shipping container, while only 1,020 tables that lack such features could be stored in a standard shipping container. Thus, the features described above may allow about seventeen percent (17%) more tables to be shipped in a standard shipping container, which may significantly reduce shipping costs. In another example, a conventional folding table may include first and second sections that have a height of about one and one-half (1.5) inches and the table may have a thickness of at least three (3.0) inches in the folded position. The features described above may allow a more compact folding table to have first and second sections that have a height of about one and one-half (1.5) inches and with similar strength, rigidity and characteristics as a conventional folding table, but only a thickness of about two and one-half (2.5) inches in the folded position. This may allow the thickness of the table in the folded position to be decreased by about seventeen percent (17%) from a similar conventional table. Significantly, this may allow six tables with a thickness of about two and one-half (2.5) inches in the folded position to be disposed in the same space as five tables with a thickness of about three (3) inches. This may also allow twenty-four tables including one or more of the features described above to be disposed in the same space as twenty tables with a thickness of about three (3.0) inches. Importantly, the features disclosed above may allow a plurality of tables to be more efficiently stored, stacked, shipped, packaged and transported. This may significantly reduce costs for the manufacturer because transportation costs may be decreased, allow retailers to more efficiently store and display the tables, and allow businesses, consumers and purchasers to save a considerable amount of space.

Another aspect is a folding table that may include a table top with a first section and a second section, a first support structure movable between an extended position and a collapsed position relative to the first section of the table top, a second support structure movable between an extended position and a collapsed position relative to the second section of the table top, a frame, and a hinge assembly connecting the first portion of the frame and the second portion of the frame. The frame may include a first portion connected to the first section of the table top, and the first portion of the frame may include a body and an engaging portion. The frame may also include a second portion connected to the second section of the table top, and the second portion of the frame may include a body and a receiving portion. The frame may include an unfolded position in which the first portion and the second portion of the frame are generally disposed along an axis and the engaging portion is spaced apart from the receiving portion. The frame may further include a folded position in which the engaging portion is disposed in the receiving portion, which may allow the height of the frame to be decreased.

Advantageously, the engaging portion and the receiving portion may at least substantially overlap when the frame is in the folded position. In addition, the engaging portion may include a first engagement surface that contacts a first portion of the receiving portion when the frame is in the folded position. The engaging portion may further include a second engagement surface that contacts a second portion of the receiving portion when the frame is in the folded position, and the first and second engagement surfaces of the engaging portion may be spaced apart by a distance and disposed at an angle. Significantly, the frame in the folded position may have a height that is at least ten percent (10%) less than a height of the first portion of the frame and the second portion of the frame. The height of the frame in the folded position may also be at least about fifteen percent (15%) smaller than the height of the first portion of the frame and the second portion of the frame. In addition, the frame in the folded position may have a height that is about twenty percent (20%) less than a height of the first portion of the frame and the second portion of the frame. Additionally, the first and second portions of the frame may have generally the same size, shape and configuration; may be generally aligned and coplanar; and may have an inverted position relative to a lower surface of the table top to allow the engaging portion to be disposed in the receiving portion when the frame is in the folded position.

Still another aspect is a table that may include a frame in which the engaging portion may be at least substantially disposed in the receiving portion when the frame is in the folded position. The engaging portion and the receiving portion may also be generally aligned and coplanar when the frame is in the folded position and the unfolded position. Additionally, the first and second portions of the frame may have generally L-shaped configurations, and the generally L-shaped first and second portions of the frame may nest together when the frame is in the folded position. Further, the first portion of the frame may include a receiving portion and the second portion of the frame may include an engaging portion, the engaging portion of the second portion of the frame may be disposed in the receiving portion of the first portion of the frame when the frame is in the folded position, and the engaging portion of the second portion of the frame may be spaced apart from the receiving portion of the first portion of the frame when the frame is in the unfolded position.

Yet another aspect is a folding table that may include a frame which rotates about an axis of rotation between the folded and unfolded positions, and the axis of rotation may be disposed between an upper surface of the engaging portion and a lower surface of the receiving portion when the frame is in the folded position. The axis of rotation may also be disposed between a body of the first portion of the frame and a body of the second portion of frame when the frame is in the folded position. In addition, the axis of rotation may be disposed below an outermost portion of the first portion of the frame and an outermost portion of the second portion of the frame when the frame is in the folded position.

Still yet another aspect is a frame for a folding table top that may include a first portion with an elongated body and an engaging portion; and a second portion with an elongated body and a receiving portion. The first and second portions of the frame may include an unfolded position in which the first portion and the second portion of the frame are generally aligned along an axis and the engaging portion is spaced apart from the receiving portion. The first and second portions of the frame may also include a folded position in which the engaging portion is disposed in the receiving portion.

These and other aspects, features and advantages of the present invention will become more fully apparent from the following brief description of the drawings, the drawings, the detailed description of preferred embodiments and appended claims.

BRIEF DESCRIPTION OF THE DRAWINGS

The appended drawings contain figures of preferred embodiments to further illustrate and clarify the above and other aspects, advantages and features of the present invention. It will be appreciated that these drawings depict only preferred embodiments of the invention and are not intended to limit its scope. The invention will be described and explained with additional specificity and detail through the use of the accompanying drawings in which.

DETAILED DESCRIPTION OF THE PREFERRED EMBODIMENTS

The present invention is directed towards folding tables. The principles of the present invention, however, are not limited to folding tables. It will be understood that, in light of the present disclosure, the tables disclosed herein can be successfully used in connection with other types of tables, furniture and the like.

Additionally, to assist in the description of the tables, words such as top, bottom, front, rear, right and left may be used to describe the accompanying figures. It will be appreciated that the tables can be disposed in other positions, used in a variety of situations and may perform a number of different functions. In addition, the drawings may be to scale and may illustrate various configurations, arrangements, aspects and features of the table. It will be appreciated, however, that the tables may have other suitable shapes, sizes, configurations and arrangements depending, for example, upon the intended use of the table. Further, the table may include any suitable number or combination of aspects, features and the like. A detailed description of exemplary embodiments of the tables now follows.

Figure 1:
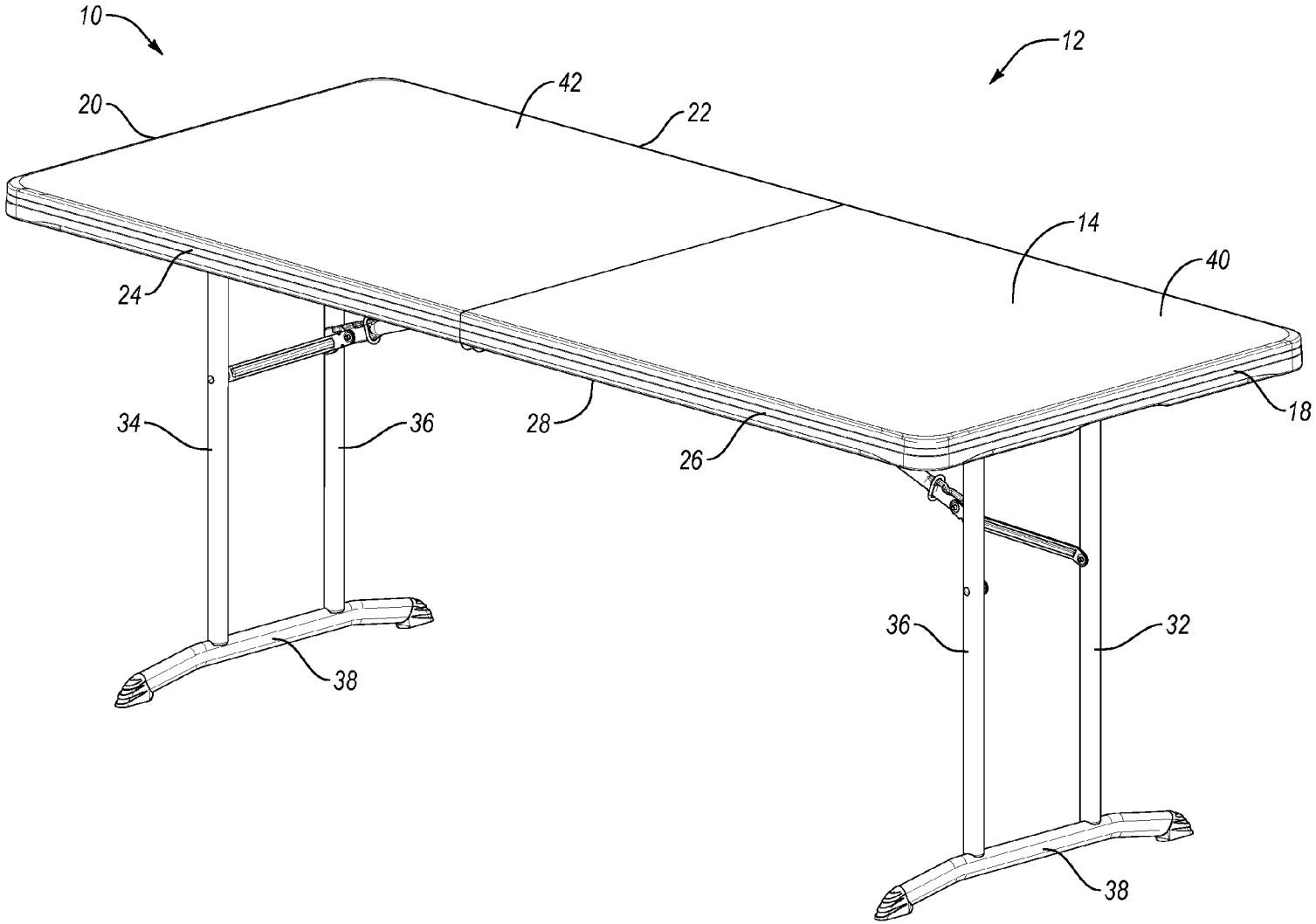
FIG. 1 is an upper perspective view of an exemplary table.

As shown in FIG. 1, the table 10 may include a table top 12 with an upper portion or surface 14, a lower portion or surface 16, a first end 18, a second end 20, a first side 22 and a second side 24. The upper surface 14 of the table top 12 is preferably generally planar to create a working surface, but the upper surface could also be textured and have other suitable configurations depending, for example, upon the intended use of the table. The table top 12 may also include an edge 26 that is disposed about the outer perimeter or periphery of the table top. All or a portion of the edge 26 may be beveled, sloped or rounded to, for example, increase the comfort and safety of the user. The table top 12 may also include a downwardly extending lip 28 disposed near or at least proximate the outer portion or perimeter of the table top. The lip 28 preferably extends downwardly relative to the lower surface 16 of the table top 12 and the lip may be aligned with or form a part of the edge 26 of the table top. It will be appreciated that the lip 28 may also be spaced inwardly from the edge 26 of the table top 12. It will also be appreciated that the table 10 and its various components may have other shapes, sizes, configurations and arrangements, such as disclosed in U.S. Pat. Nos. 6,530,331; 7,111,563; 7,475,643; 7,814,844; and 7,975,625; each of which are incorporated by reference in its entirety. It will further be appreciated that the table 10 may also include any suitable number and combination of features and aspects depending, for example, upon the intended use of the table.

As shown in the accompanying figures, the table top 12 may have a generally rectangular configuration with rounded corners. The table top 12 may have a relatively large size and the table 10 may be configured for use as a banquet or utility table. For example, the table top 12 may have a length of about five feet (or about sixty inches) and a width of about two and one-half feet (or about thirty inches), but the table top can be larger or smaller. For instance, the table top 12 could be between about six and ten feet in length, and between about two and three feet in width. One skilled in the art will appreciate the table top 12 can be larger or smaller; may have other suitable shapes and configurations such as square, circular, oval and the like; and the sides, corners, edges and other portions of the table top could have various shapes, sizes, configurations and arrangements depending, for example, upon the intended use of the table 10. Further, the table 10 could be any suitable type of table such as a folding table, non-folding table, card table, personal table, round table and the like.

The table top 12 may be constructed from lightweight materials such as plastic. In particular, the table top 12 may be constructed from high density polyethylene but other suitable materials can be used. The table top 12 may be constructed from blow-molded plastic which may allow a relatively strong, lightweight, rigid and sturdy table top to be quickly and easily manufactured. The blow-molded plastic table top may be lightweight because it may include a hollow interior portion formed during the blow-molding process. The blow-molded plastic table top 12 may also be relatively durable, weather resistant, temperature insensitive, corrosion resistant, rust resistant and may not deteriorate over time. One of ordinary skill in the art will appreciate the table top 12 does not have to be constructed from blow-molded plastic and other suitable materials and/or processes could be used. For example, the table top 12 may be constructed from other types of plastics, polymers and synthetic materials; and different processes such as injection molding, rotational molding, rotary molding, etc. In addition, the table top 12 may be constructed from other materials with sufficient strength and desirable characteristics such as wood, metals, alloys, composites, fiberglass, ceramics and the like.

Figure 2:
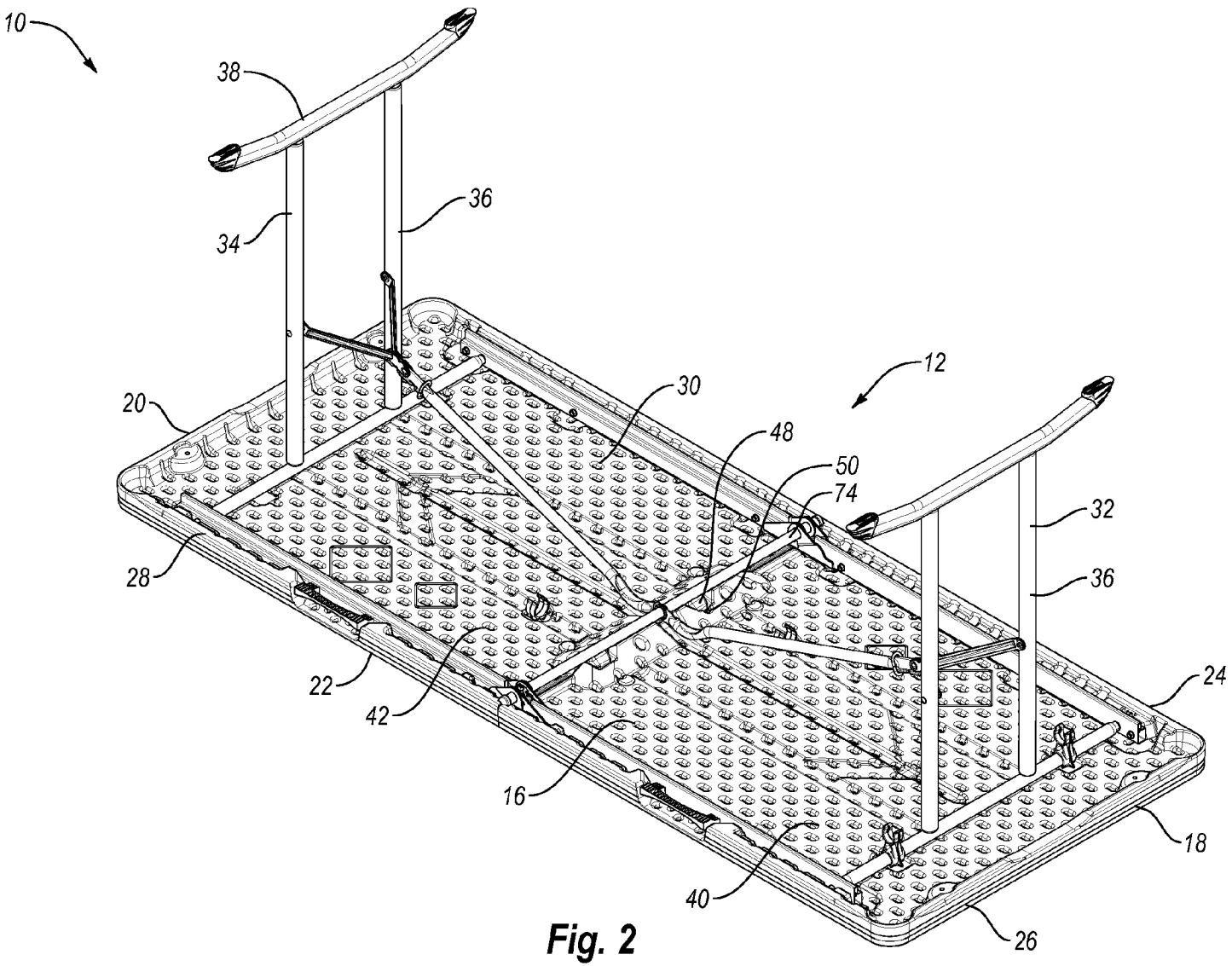
FIG. 2 is a lower perspective view of the table shown in FIG. 1, illustrating the support members in extended positions.
Figure 3:
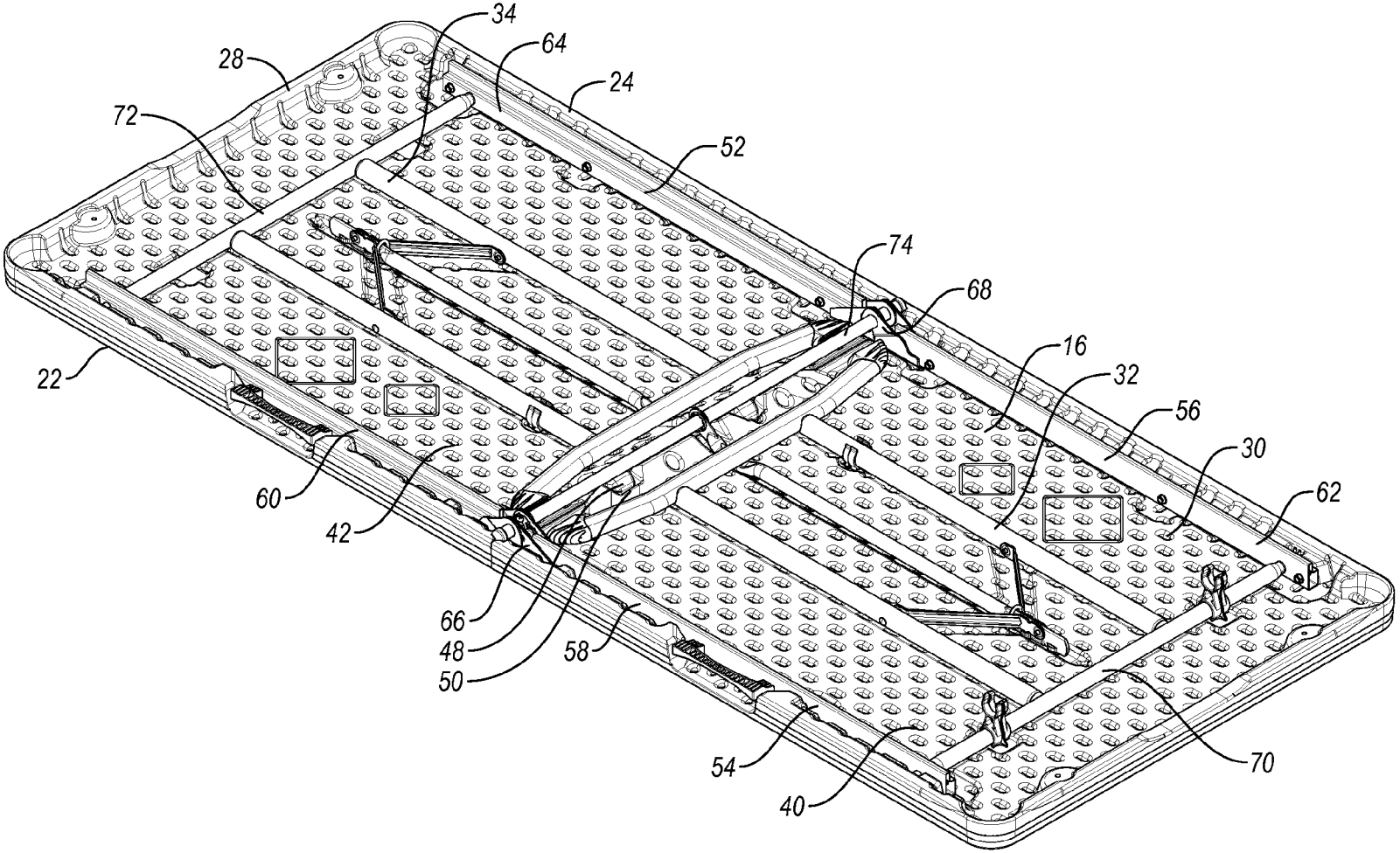
FIG. 3 is another lower perspective view of the table shown in FIG. 1, illustrating the support members in collapsed positions.
Figure 4:
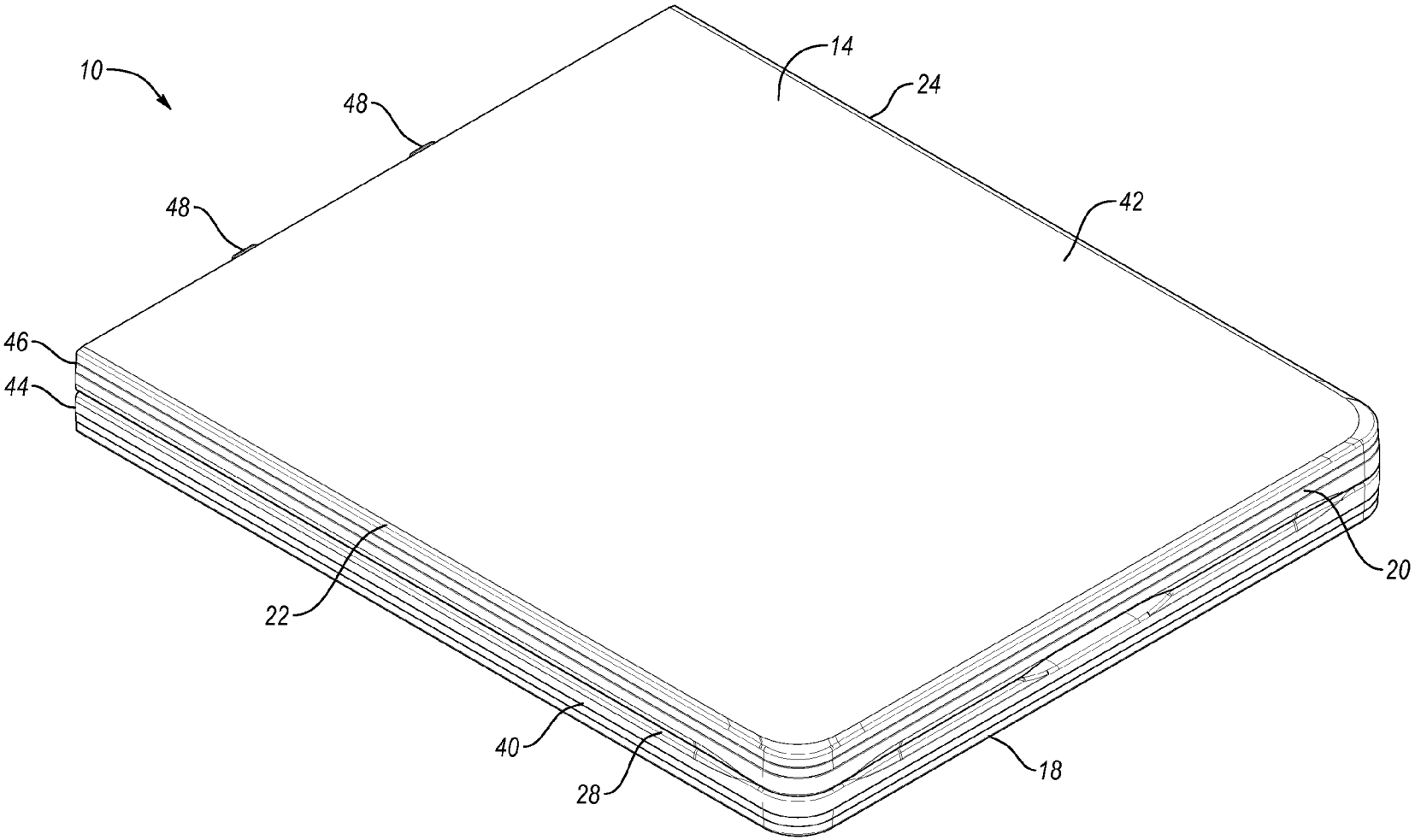
FIG. 4 is an upper perspective view of the table shown in FIG. 1, illustrating the table in a folded position.
Figure 5:
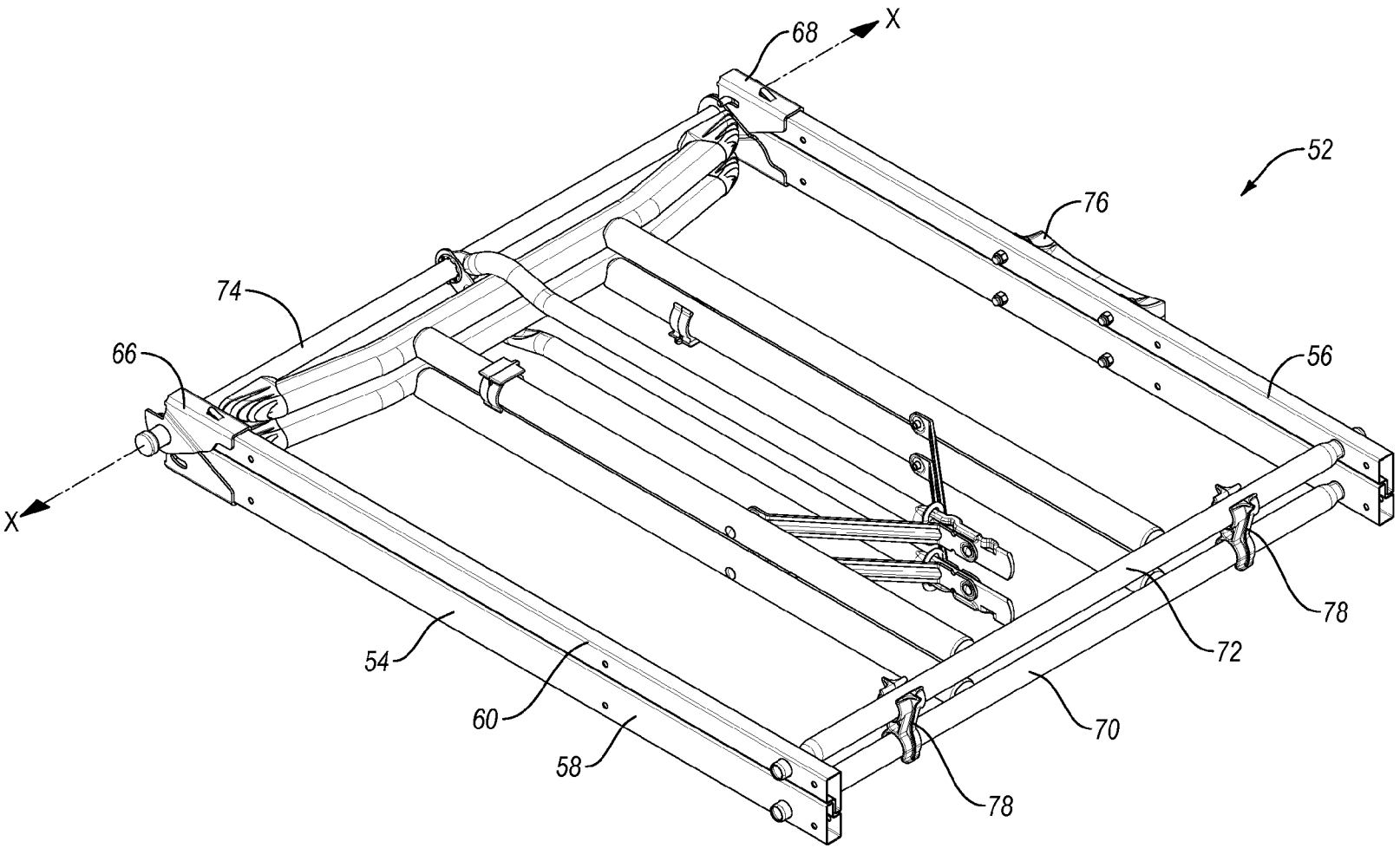
FIG. 5 is an upper perspective view of a portion of the table shown in FIG. 1, illustrating the frame in a folded position and the support members in collapsed positions.
Figure 6:
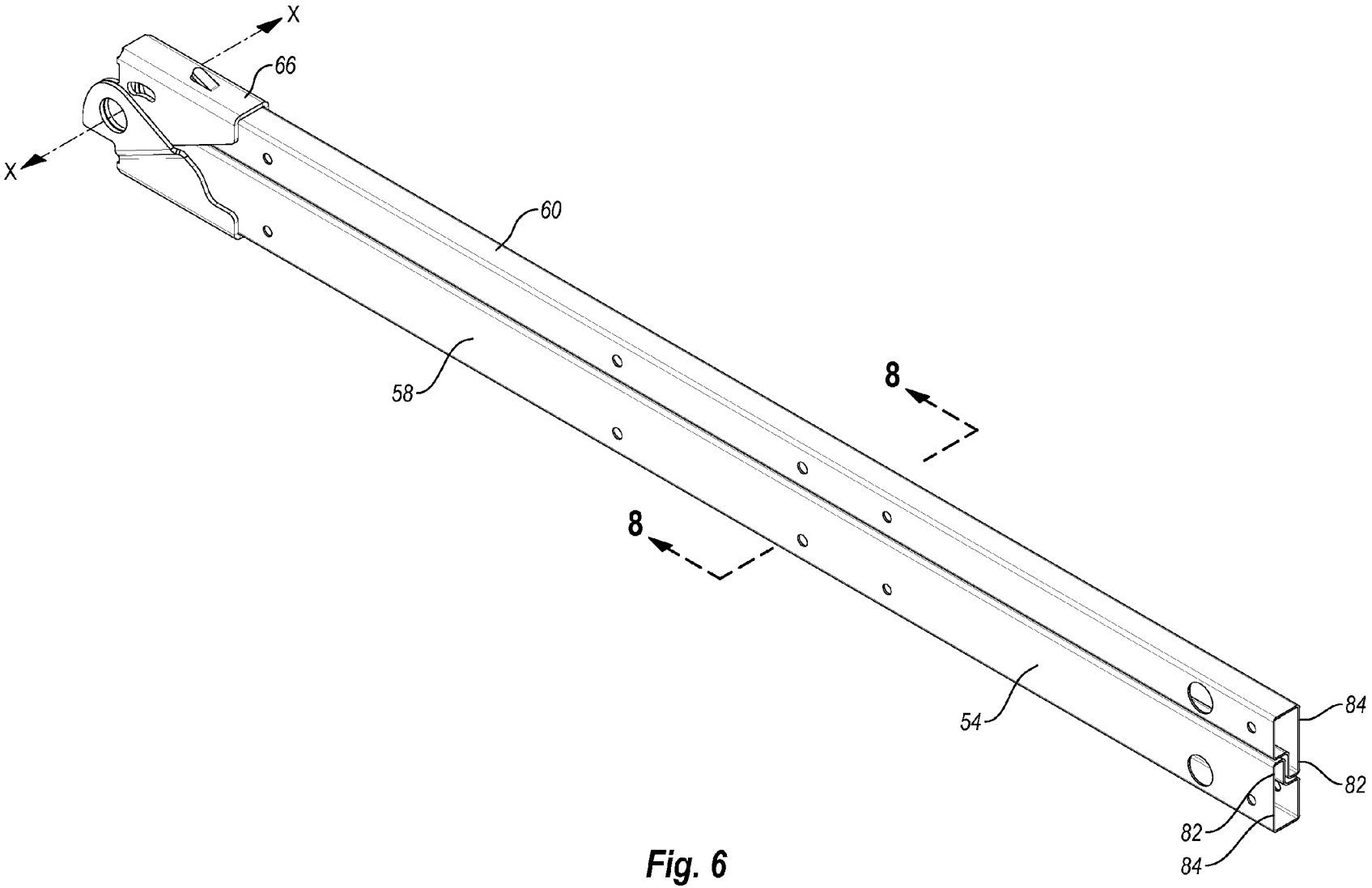
FIG. 6 is an enlarged view of a portion of the frame shown in FIG. 5, illustrating a side rail in a folded position.
Figure 7:
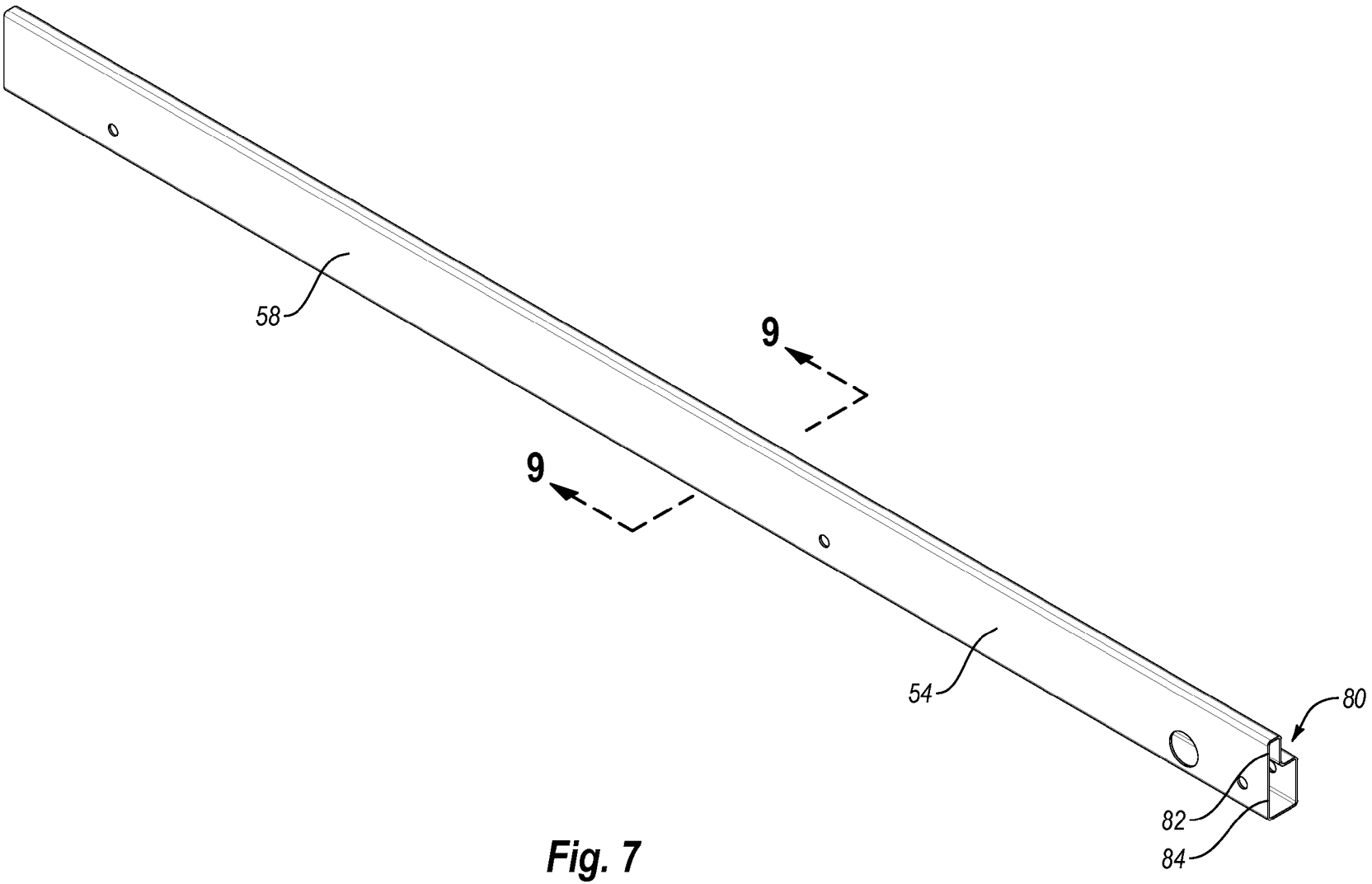
FIG. 7 is an enlarged view of another portion of the frame shown in FIG. 5, illustrating a portion of a side rail.

The table top 12 may include spaced apart outer walls, such as the upper and lower surfaces 14, 16, which may help create a strong and rigid table top. For instance, the upper and lower surfaces 14, 16 of the table top 12 may be separated by a generally constant distance and the surfaces may be generally aligned in parallel planes. As shown in FIGS. 2 and 3, the table top 12 may also include one or more tack-offs, kiss-offs or depressions 30. The depressions 30 may be disposed in the lower surface 16 of the table top 12 and the depressions may be sized and configured to increase the strength and/or rigidity of the table top. The depressions 30 may also be used to create a table top 12 with more uniform properties and characteristics, and the depressions may cover a majority, substantially all or the entire lower surface 16 of the table top. Advantageously, the depressions 30 can be integrally formed with the table top 12 as part of a unitary, one-piece construction or structure, and the depressions may be formed in any desired portions of the table top. The depressions 30, and other portions of the table 10, may have other shapes, sizes, configurations, arrangements and features, such as disclosed in U.S. Pat. Nos. 7,069,865; 7,114,453; 7,143,702; and 7,210,277; U.S. patent publication no. 2006-0230989; which are each incorporated by reference in its entirety.

The table 10 may include one or more support structures sized and configured to support the table top 12 above a surface. For example, the table 10 may include a first support structure 32 and a second support structure 34, and each support structure may include one or more legs or supports 36, and the legs may be connected by a connecting member or foot 38. The support structures 32, 34 may be movable between an extended or use position in which the legs 36 extend outwardly from the table top 12 and a collapsed or storage position in which the legs are disposed at least proximate the table top. The table 10 may include any suitable number, shape, size, configuration and arrangement of support structures 32, 34; legs 36 and/or feet 38 depending, for example, upon the intended use of the table.

The table 10 may be a folding table and the table top 12 may include a first section 40 and a second section 42. As shown in the accompanying figures, the first support structure 32 may be movable between the extended and collapsed positions relative to the first section 40 of the table top 12. The second support structure 34 may be movable between the extended and collapsed positions relative to the second section 42 of the table top 12. In addition, the first and second sections 40, 42 of the table top 12 may be foldable about an axis between an unfolded position and a folded position. The first and second sections 40, 42 may be generally aligned in the same plane when the table top 12 is in the unfolded position, and the first and second table top sections may be disposed generally adjacent and parallel to each other when the table top is in the folded position.

As shown in the accompanying figures, the first and section sections 40, 42 of the table top 12 may have a generally rectangular configuration with a symmetrical or mirror-image configuration. In addition, the first section 40 of the table top 12 may include an inner surface 44 that is sized and configured to contact and/or engage an inner surface 46 of the second section 42 of the table top when the table top is in the unfolded position. The inner surfaces 44, 46 may then be spaced apart when the table top 12 is in the folded position. The inner surfaces 44, 46 of the table top 12 may include one or more interlocking, overlapping and/or intertwined portions, such as an engaging portion 48 and a receiving portion 50, which may provide additional strength, stability and/or rigidity to at least the center portion of the table top. The table top 12 may also have other shapes, sizes, configurations and arrangements, such as shown in U.S. Pat. No. 7,096,799, which is incorporated by reference in its entirety.

The table 10 may further include a frame 52 that is connected to the table top 12. In particular, the frame 52 may be connected to the lower surface 16 of the table top 12. The frame 52 may include one or more rails, such as a first side rail 54 and a second side rail 56, which may extend along a length of the table top 12. The side rails 54, 56 are preferably positioned near opposing edges 26 and/or sides 22, 24 of the table top 12. In particular, the side rails 54, 56 may be disposed at least proximate the lip 28 and there may be a gap or space between the side rails and the lip. The side rails 54, 56 preferably extend almost the entire length of the table top 12, which may provide increased strength and rigidity for the table top, but the side rails may extend along only a portion of the table top and the side rails may not be required.

In greater detail, the first side rail 54 may be disposed towards the first side 22 of the table top 12 and this side rail may include a first portion 58 connected to the first section 40 of the table top and a second portion 60 connected to the second section 42 of the table top. The second side rail 56 may be disposed towards a second side 24 of the table top 12 and this side rail may include a first portion 62 connected to the first section 40 of the table top and a second portion 64 connected to the second section 42 of the table top.

The first and second side rails 54, 56 of the frame 52 may be pivotally connected by first and second hinge assemblies 66, 68 respectively, to allow the table top 12 to be moved between the folded and unfolded positions. In particular, the first hinge assembly 66 may be connected to the first side rail 54 and the second hinge assembly 68 may be connected to the second side rail 56.

In addition, the first and second support structures 32, 34 may be connected to the frame 52. For example, a first cross member 70 may connect the frame 52 and the first support structure 32, and a second cross member 72 may connect the frame and the second support structure 34. In greater detail, the ends of the first and second cross members 70, 72 may be disposed in openings in the side rails 54, 56 of the frame 52 to allow the cross members to rotate relative to the frame. The cross members 70, 72 may also be connected to the frame 52, and the table 10 may include other features, such as shown in U.S. Pat. No. 7,100,518, which is incorporated by reference in its entirety. Advantageously, the cross members 70, 72 may form part of the frame 52 and/or the support structures 32, 34, depending, for example, upon the particular arrangement and/or configuration of the table 10.

A cross member 74 may be disposed at least proximate a center portion of the table top 12. The cross member 74 may be aligned with an axis of rotation X of the table top 12 between the folded and unfolded positions, and the cross member may be connected to the hinge assemblies 66, 68. The cross member 74 may be coupled to the hinge assemblies 66, 68 or other suitable portions of the table 10. In addition, the cross member 74 may be disposed in a fixed position relative to the table top 12 or it may move relative to the table top, and the cross member may also be disposed in one or more receiving portions. These and other features that may be used in connection with the table 10 are disclosed in U.S. patent publication no. 2011/0203493, entitled "Folding Table with Locking Member," which was filed on Feb. 2, 2011, now U.S. Pat. No. 8,397,653; and U.S. patent publication no. 2011/0203494, entitled "Table," which was filed on Feb. 2, 2011; and U.S. patent publication no. 2013-0025509, entitled "Folding Table with Locking Member," filed on Jul. 26, 2012, which are each incorporated by reference in its entirety.

The table 10 may also include other components such as a handle 76 that may be connected to the first and second side rails 54, 56 of the frame 52. Additionally, the table 10 could include one or more clips 78 that may be used to help maintain the table top 12 in the folded position. While the table 10 may include handles 76, clips 78 and other features, none of these features may be required.

As discussed above, the frame 52 may be sized and configured to provide the table 10 with generally the same, equivalent or even greater strength and/or rigidity than a conventional frame for a similar table, but the frame 52 may allow the table 10 to be disposed in a much more compact configuration in the folded position. Importantly, the compact configuration may decrease transportation costs because, for example, more tables 10 may be shipped in the same area (such as on a pallet or in a shipping container) and/or the tables may require less space or volume. Advantageously, the compact configuration may also decrease the area required for storing the tables 10. This may reduce costs for the manufacturer and retailer because less storage space may be needed. In addition, purchasers and consumers may store the tables 10 in smaller areas, which may increase the usefulness and situations in which the tables may be used. Further, the compact configuration of the table 10 may be very beneficial to larger facilities such as hotels, schools and convention centers because multiple tables may be more easily stored and moved. Smaller facilities such as restaurants, retailers and homes may also prefer the compact configuration of the table 10 because the tables may be more efficiently stowed and transported.

The frame 52 may have comparable characteristics, such as strength and weight, to a conventional metal frame because both frames may have the same general size and configuration. In particular, the strength and rigidity of a table may be directly proportional to the height and width of the side rails of the frame. Thus, the side rails 54, 56 of the frame 52 may have the same general height and width as the side rails of a conventional metal frame. Therefore, the side rails 54, 56 of the frame 52 may have the same general height and width as a conventional frame in the unfolded position. The side rails 54, 56 of the frame 52, however, provide a significant decrease in height in the folded position when compared to a conventional frame. Because the frame 52 of the table 10 may have a significantly smaller height than a conventional frame in the folded position, the height of the folded table may be considerably decreased. For example, the frame 52 may allow the folded table 10 to have a height between about fifteen percent (15%) and about twenty percent (20%) smaller than a height of a conventional folded table. In particular, the folded table 10 may have a height that is about seventeen percent (17%) less than a conventional folded table. This may allow the table 10 to have a height of about 2.5 inches in the folded position while a similar conventional folding table has a height of at least 3.0 inches or more in the folded position. This may advantageously result in sizable savings in shipping, transportation and storage costs of the table 10 in comparison to a similar conventional table.

In greater detail, the side rails 54, 56 of the frame 52 may include at least one receiving portion 80 and/or at least one engaging portion 82. In particular, the side rails 54, 56 may include one or more receiving portions 80, one or more engaging portions 82, and/or a combination of receiving and engaging portions. The receiving portions 80 may be sized and configured to receive at least a portion of the engaging portions 82 when the frame 52 is folded. Similarly, the engaging portions 82 may be sized and configured to be at least partially disposed in the receiving portions 80 when the frame 52 is folded.

For example, as seen in FIGS. 6-9, the first portion 58 of the first side rail 54 may include both a receiving portion 80 and an engaging potion 82. The second portion 60 of the first side rail 54 may also include both a receiving portion 80 and an engaging portion 82. The engaging and receiving portions 80, 82 may be sized and configured to interact when the frame 52 is in the folded position. For instance, the engaging portion 82 of the first portion 58 of the first side rail 54 may be disposed in the receiving portion 80 of the second portion 60 of the first side rail. In addition, the engaging portion 82 of the second portion 60 of the first side rail 54 may be disposed in the receiving portion 80 of the first portion 58 of the first side rail when the frame 52 is in a folded position.

The side rails 54, 56 may also be viewed as including only receiving portions 80 and/or engaging portions 82. For instance, the first portion 58 of the first side rail 54 may be viewed as only including the receiving portion 80 and the second portion 60 of the first side rail 54 may be seen as only including the engaging portion 82. Alternatively, the first portion 58 of the first side rail 54 could be viewed as having the engaging portion 82 while the second portion 60 of the first side rail 54 could be viewed as having the receiving portion 80. Thus, it will be understood the first and second portions 58, 60 of the first and second side rails 54, 56 may include one or more receiving portions 80, one or more engaging portions 82, or both receiving and engaging portions.

The receiving and/or engaging portions 80, 82 of the side rails 54, 56 may interact to allow the height of the frame 52 to be decreased in the folded position. In particular, the side rails 54, 56 may have a height and a width that is generally the same as a conventional frame for a similar table, but the receiving and engaging portions 80, 82 may overlap, interlock and/or nest to reduce the height of the frame 52 in the folded position. For example, the side rails of a conventional frame may have a rectangular configuration with a height of about one and one-half (1.5) inches and a width of about three-quarters (0.75) of an inch. Thus, in the folded position, a conventional frame may have a height of about three (3.0) inches. The receiving and engaging portions 80, 82 of the side rails 54, 56, however, may significantly reduce the height of the frame 52 in the folded position but still maintain the same general appearance, strength and rigidity as a frame for a conventional table.

Figure 11:
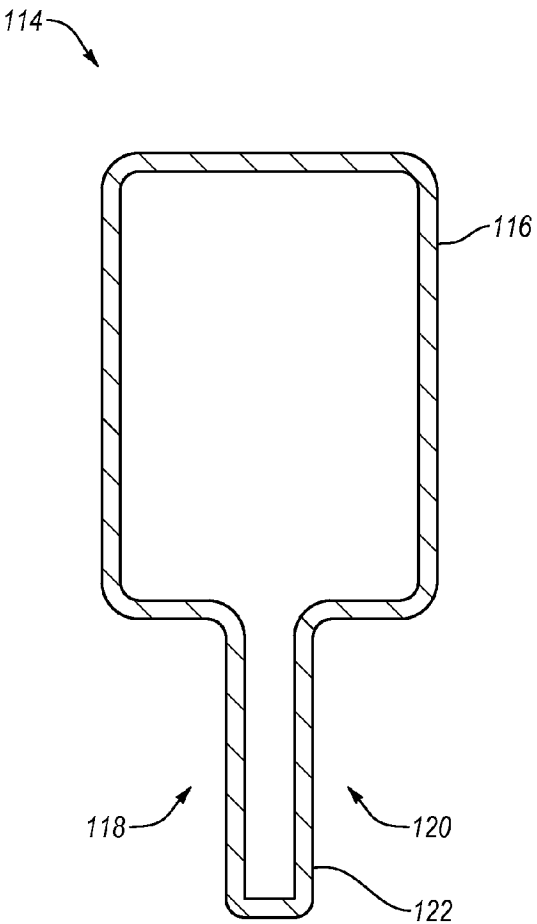
FIG. 11 is a cross-sectional view of a portion of still another exemplary frame, illustrating a rail with a generally T-shaped configuration.

The first and second portions 58, 60, 62, 64 of the first and second side rails 54, 56 may have a generally L-shaped configuration. In this exemplary configuration, an outwardly extending portion may form the engaging portion 82 and a notch or cutout may form the receiving portion 80. The receiving and/or engaging portions 80, 82 may be sized and configured to interact with a corresponding rail when the frame 52 is in the folded position. The receiving and/or engaging portions 80, 82 may also have other shapes, sizes, configurations and arrangements depending, for example, upon the frame 52 or the intended use of the table 10. Further, the rails may have other shapes, sizes, configurations and arrangements, such as generally U-shaped, generally T-shaped, generally W-shaped and the like, which are described in more detail below in connection with FIGS. 10-12. Therefore, it will be understood by a person of ordinary skill in the art after reviewing the disclosure herein that the frame 52; the side rails 54, 56; the receiving portions 80 and the engaging portions 82 may have other shapes, sizes, configurations and arrangements.

Advantageously, the first and second portions 58, 60, 62, 64 of the first and second rails 54, 56 may have generally the same shape, size, configuration and arrangement. In particular, the first and second portions 58, 60, 62, 64 of the first and second side rails 54, 56 may be symmetrical, mirror-images and/or disposed in inverted positions, which may facilitate manufacturing, connecting the frame 52 to the table top 12 and the like. Thus, for brevity, the first side rail 54 will be described in more detail and the second side rail 56 may have a similar configuration, but it will be understood the first and second side rails could also have different shapes, sizes, configurations and arrangements. Further, while the accompanying figures illustrate the frame 52 as including two side rails 54, 56 connected to opposing sections 40, 42 of a table top 12, the frame could have any number of rails and/or components connected to any suitable portions of the table top.

Figure 9:
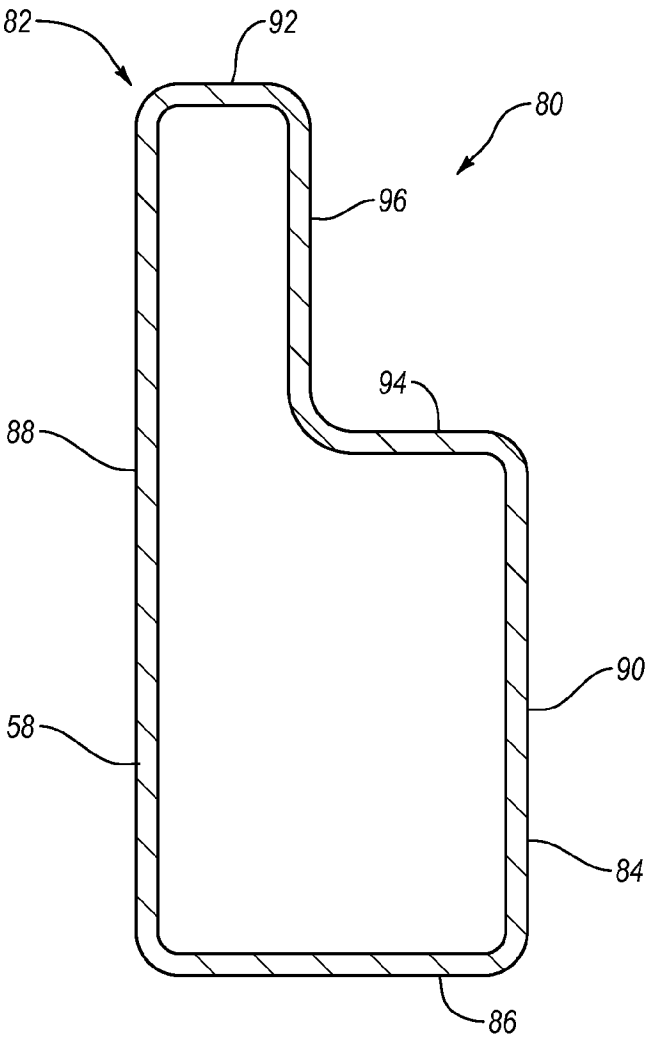
FIG. 9 is an enlarged cross-sectional view along lines 9-9 of the portion of the side rail shown in FIG. 7.
Figure 8:
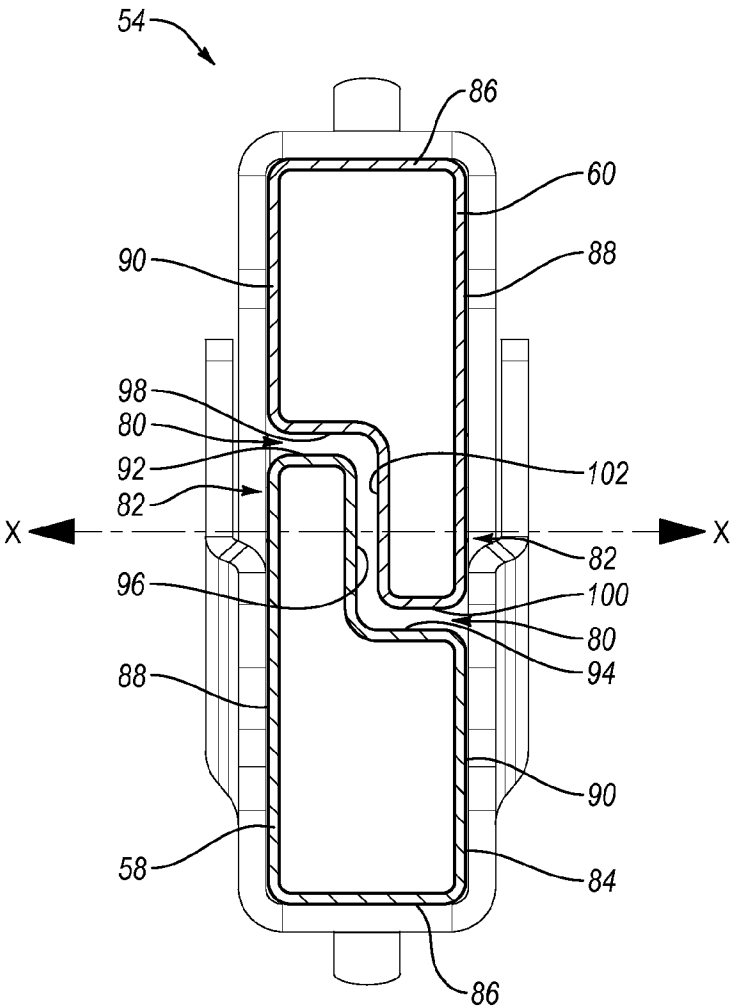
FIG. 8 is an enlarged cross-sectional view along lines 8-8 of the side rail shown in FIG. 6.

As best seen in FIGS. 8 and 9, the first and second portions 58, 60 of the first side rail 54 may each include a body 84 with a generally rectangular or square configuration and the body may have an end 86, a first side 88 and a second side 90. The engaging portion 82 may extend outwardly from the body 84. The receiving portion 80 may be disposed adjacent to the engaging portion 82 and the receiving portion may be disposed at or proximate the interconnection of the engaging portion and the body 84. The receiving portion 80 may also be a notch, cutout or opening in the body 84.

The engaging portion 82 is preferably sized and configured to be at least partially disposed in the receiving portion 80 when the frame 52 is folded. In addition, one or more portions of the frame 52 may contact or abut when the frame is folded. For example, the first portion 58 of the first side rail 54 may include a first surface 92, a second surface 94 and a third surface 96. The second portion 60 of the first side rail 54 may include a first surface 98, a second surface 100 and a third surface 102. As a non-limiting example, the first and second surfaces 92, 94 and 98, 100 may be substantially parallel to one another; and the third surfaces 96, 102 may be substantially perpendicular to the first and/or second surfaces. In addition, the receiving portion 80 and the engaging portion 82 of the first and second portions 58, 60 of the first side rail 54 may be juxtaposed or positioned such that the first surfaces 92, 98; the second surfaces 94, 100; and/or the third surfaces 96, 102 may be adjacent, contact and/or abut when the frame 52 is folded. In particular, the first surface 92, the second surface 94 and the third surface 96 of the first portion 58 of the first side rail 54 may be adjacent, contact and/or abut the first surface 98, the second surface 100 and the third surface 102 of the second portion 60 of the first side rail, respectively. The first, second and third surfaces 92, 94, 96 of the first portion 58 may, thus, be viewed as engaging surfaces and the first, second and third surfaces 98, 100, 102 of the second portion 60 may be viewed as receiving surfaces. Alternatively, the first, second and third surfaces 92, 94, 96 of the first portion 58 may be viewed as receiving surfaces, and the first, second and third surfaces 98, 100, 102 of the second portion 60 may be viewed as engaging surfaces. While the second side rail 56 may have substantially the same configuration as the first side rail 54, the side rails may also have other suitable configurations.

Advantageously, the receiving and engaging portions 80, 82 may allow the height of the frame 52 to be significantly decreased in the folded position. In addition, the receiving and engaging portions 80, 82 may help align the frame 52 and/or secure the frame in a fixed position when the frame is folded. In addition, because the receiving and engaging portions 80, 82 may have complementary or corresponding shapes, sizes, configurations and/or arrangements, the receiving and engaging portions may be interchangeable. Thus, the frame 52 could include any suitable combination, number and/or arrangement of receiving and engaging portions 80, 82.

In particular, the receiving and engaging portions 80, 82 may have generally the same size. For example, the receiving and engaging portions 80, 82 may each have a width approximately equal to or less than one-half of a width of the body 84 of the side rails 54, 56. The receiving portion 80 may have a depth and the engaging portion 82 may have a height that is approximately equal to one-third of a height of the body 84 of the side rails 54, 56. It will be understood the receiving and engaging portions 80, 82 may have other suitable dimensions such as a width between about one-third and about one-fourth of the width of the side rails 54, 56; and/or a height or depth between about one-half and about one-quarter of the height of the body 84 of the side rails. In particular, an exemplary embodiment of the side rails 54, 56 may include a body 84 with a height of about one (1.0) inch and a width of about three-quarters (0.75) of an inch. The engaging portion 82 may have a height of about six-tenths (0.6) of an inch so the overall height of the side rails 54, 56 may be about one and six-tenths (1.6) inches. Thus, a comparable conventional frame would have a height of about three and two-tenths (3.2) inches in the folded position, but this exemplary frame may only have a height of about two (2.0) inches in the folded position. Therefore, this exemplary frame would have a height that is approximately thirty-eight percent (38%) less than a corresponding conventional frame. It will also be understood the frame 52; the side rails 54, 56; and the receiving and engaging portions 80, 82 may have other suitable shapes, sizes, configurations and arrangements depending, for example, upon the intended use of the table 10.

Figure 12:
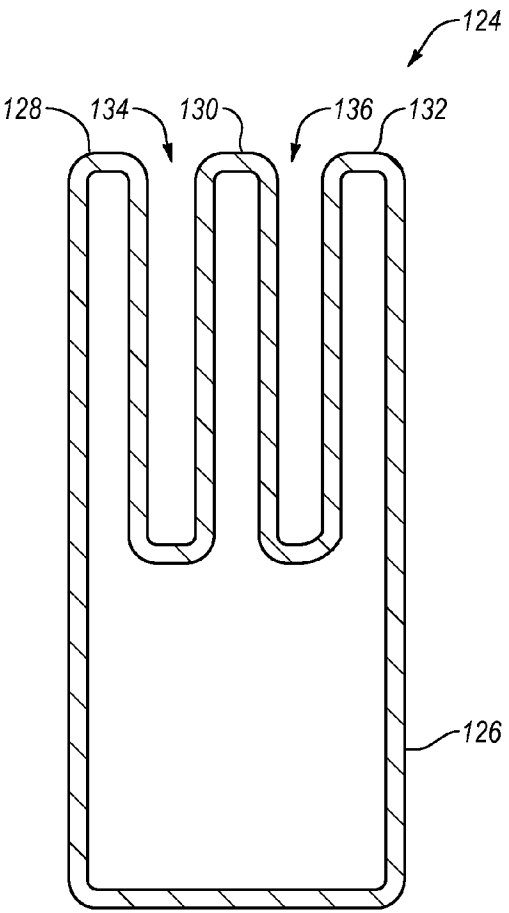
FIG. 12 is a cross-sectional view of a portion of yet another exemplary frame, illustrating a rail with a generally W-shaped configuration.
Figure 10:
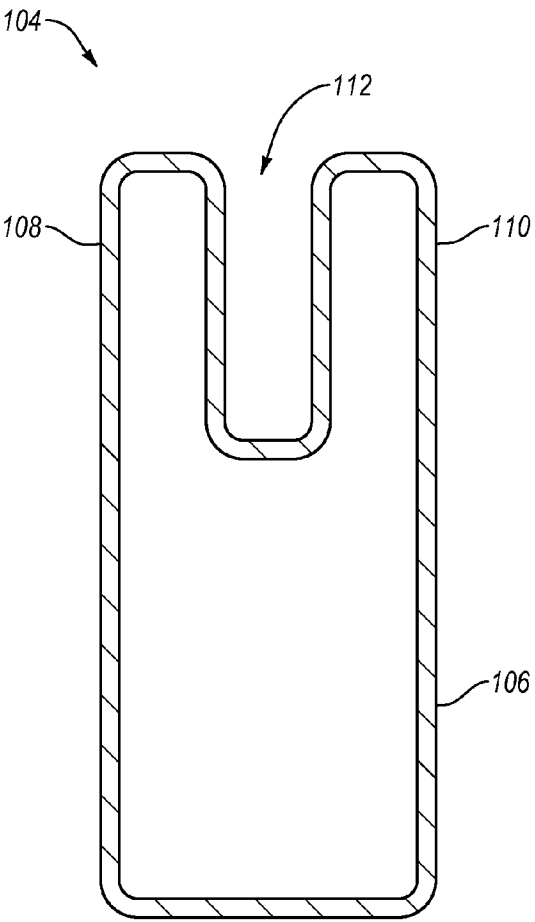
FIG. 10 is a cross-sectional view of a portion of another exemplary frame, illustrating a rail with a generally U-shaped configuration.

For instance, as shown in FIG. 10, the frame 52 could include a rail 104 with a generally U-shaped configuration with a body 106, a first engaging potion 108, a second engaging portion 110 and a receiving portion 112. The frame 52 could also include a corresponding rail with one or more receiving portions to receive the first and second engaging portions 108, 110 of the rail 104 when the frame is in the folded position and/or one or more engaging portions disposed in the receiving portion 112 of the rail 104 when the frame is in the folded position. In another example embodiment shown in FIG. 11, the frame 52 could include a rail 114 with a generally T-shaped configuration with a body 116, a first receiving portion 118, a second receiving portion 120 and an engaging portion 122. A corresponding rail could include one or more engaging portions sized disposed in the receiving portions 118, 120 of the rail 114 when the frame 52 is in the folded position and/or a receiving portion to receive the engaging portion 122 of the rail 114 when the frame is in the folded position. Further, as shown in FIG. 12, yet another exemplary rail 124 could have a generally W-shaped configuration with a body 126, a first engaging portion 128, a second engaging portion 130 and a third engaging portion 132. The rail 124 could also include a first receiving portion 134 and a second receiving portion 136 disposed between the engaging portions 128, 130, 132. A corresponding rail could include a plurality of receiving portions to receive the engaging portions 128, 130, 132 of the rail 124 when the frame 52 is in the folded position and/or a plurality of engaging portions disposed in the receiving portions 134, 136 of the rail 124 when the frame is in the folded position. Thus, it will be understood by a person of ordinary skill in the art after reviewing the disclosure herein the frame, the rails, the receiving portions and/or the engaging portions may have a variety of shapes, sizes, configurations and arrangements depending, for example, upon the intended use of the table 10.

Advantageously, the frame 52 may allow the axis of rotation X to be disposed between an uppermost portion of the engaging portion 82 of the first portion 58 of the first side rail 54, such as the first surface 92, and a lower portion of the receiving portion 80 of the first portion of the first side rail, such as the second surface 94, when the frame is folded. The axis of rotation X of the frame 52 may also be disposed between the body 84 of the first portion 58 of the first side rail 54 and the body 84 of the second portion 60 of the first side rail 54 when the frame is folded. The axis of rotation X may further be disposed proximate a midpoint of the receiving portion 80 and/or the engaging portion 82 for the first and/or second portions 58, 60 of the first side rail 54. In addition, the axis of rotation X may be disposed between a portion of the first portion 58 of the first side rail 54, such as the surface 92, and a portion of the second portion 60 of the first side rail, such as the surface 100. In particular, the axis of rotation X could be disposed proximate a midpoint between the surfaces 92, 100; and/or the surfaces 94, 98. Because the axis of rotation X may be disposed below the upper portion of the side rails 54, 56, that may allow the height of the frame 52 to be decreased in the folded position.

As mentioned above, the axis of rotation X may be aligned with the cross member 74. Thus, the cross member 74 may be sized and configured such that it is disposed between the uppermost portion of the first portion 58 of the first side rail 54, such as the first surface 92, and the lower portion of the receiving portion 80 of the first portion of the first side rail, such as the second surface 94, when the frame is folded. The cross member 74 may also be disposed between the body 84 of the first portion 58 of the first side rail 54 and the body 84 of the second portion 60 of the first side rail when the frame 52 is folded. The cross member 74 may further be disposed proximate a midpoint of the receiving portion 80 and/or the engaging portion 82 for the first and/or second portions 58, 60 of the first side rail 54. In addition, the cross member 74 may be disposed between a portion of the first portion 58 of the first side rail 54, such as the surface 92, and a portion of the second portion 60 of the first side rail, such as the surface 100. Specifically, the cross member 74 could be disposed proximate a midpoint between the surfaces 92, 100; and/or the surfaces 94, 98. In addition, the cross member 74 may have a diameter that is less than the depth of the receiving portion 80 and/or the height of the engaging portion 82.

The frame 52; the hinge assemblies 66, 68; the cross members 70, 72, 74; the support structures 32, 34 and other portions of the table 10 may be constructed from relatively high-strength materials such metal, which may easily be formed into the desired configuration by known operations such as stamping and bending. These and other components of the table 10 may also be constructed from other materials such as plastics, composites, and the like. It will be appreciated that the frame 52; the hinge assemblies 66, 68; the cross members 70, 72, 74; the support structures 32, 34 and the like may have various suitable shapes, sizes, configurations and arrangements depending, for example, upon the size and shape of the table top 12 and/or the intended use of the table 10.

Although this invention has been described in terms of certain preferred embodiments, other embodiments apparent to those of ordinary skill in the art are also within the scope of this invention. Accordingly, the scope of the invention is intended to be defined only by the claims which follow.

The invention claimed is:

1. A table top for a folding table that is capable of moving between a folded position and an unfolded position, the table top comprising:

a first table top section; and a second table top section, the first table top section and the second table top section generally aligned in the same plane when the table top is in the unfolded position, the first table top section and the second table top section disposed generally adjacent and parallel to each other when the table top is in the folded position;

a frame connected to the table top, the frame comprising:

a first frame rail connected to the first table top section, the first frame rail including an engaging portion and a receiving portion; and a second frame rail connected to the second table top section, the first frame rail and the second frame rail generally aligned in the same plane, the second frame rail including an engaging portion and a receiving portion, the engaging portion of the first frame rail being at least partially disposed in the receiving portion of the second frame rail when the table top is in the folded position, the engaging portion of the second frame rail being at least partially disposed in the receiving portion of the first frame rail when the table top is in the folded position; and a hinge assembly connecting the first frame rail and the second frame rail, the hinge assembly sized and configured to allow the table top to move between the folded and the unfolded positions.

2. The table top as in claim 1, wherein the engaging portion and the receiving portion of the first frame rail define at least a portion of a generally L-shaped configuration of the first frame rail; and wherein the engaging portion and the receiving portion of the second frame rail define at least a portion of a generally L-shaped configuration of the second frame rail.

3. The table top as in claim 1, wherein the engaging portion extends outwardly from a body of the first frame rail; and wherein the engaging portion extends outwardly from a body of the second frame rail.

4. The table top as in claim 1, wherein the receiving portion comprises a cutout in a body of the first frame rail; and wherein the receiving portion comprises a cutout in a body of the second frame rail.

5. A folding table comprising:

a table top including a first section and a second section, the first and second sections movable between a folded position in which the first and second sections are disposed in a generally adjacent and parallel configuration and an unfolded position in which the first and second sections are generally aligned in the same plane;

a first support structure connected to the first section of the table top, the first support structure movable between an extended position in which the first support structure extends outwardly from the first section of the table top and a collapsed position in which the first support structure is disposed generally parallel and at least proximate the first section of the table top;

a second support structure connected to the second section of the table top, the second support structure movable between an extended position in which the second support structure extends outwardly from the second section of the table top and a collapsed position in which the second support structure is disposed generally parallel and at least proximate the second section of the table top;

a frame comprising:

a first portion connected to the first section of the table top, the first portion of the frame including a body and an engaging portion; and a second portion connected to the second section of the table top, the second portion of the frame including a body and a receiving portion, the first portion and the second portion of the frame at least substantially disposed in a plane, the first portion and the second portion of the frame generally aligned and the engaging portion is spaced apart from the receiving portion when the table is in the unfolded position, the engaging portion of the first portion of the frame at least partially disposed in the receiving portion of the second portion of the frame when the table is in the folded position; and a hinge assembly connecting the first portion of the frame and the second portion of the frame.

6. The folding table as in claim 5, wherein the engaging portion of the frame and the receiving portion of the frame at least substantially overlap when the frame is in the folded position.

7. The folding table as in claim 5, further comprising a first engagement surface of the engaging portion that contacts a first portion of the receiving portion when the frame is in the folded position.

8. The folding table as in claim 7, further comprising a second engagement surface of the engaging portion that contacts a second portion of the receiving portion when the frame is in the folded position, the first and second engagement surfaces of the engaging portion being spaced apart by a distance and disposed at an angle.

9. The folding table as in claim 5, wherein the first portion of the frame has a first height and the second portion of the frame has a second height; and wherein the height of the frame in the folded position is at least about fifteen percent smaller than the height of the first portion of the frame and the second portion of the frame.

10. The folding table as in claim 5, wherein the first portion of the frame and the second portion of the frame have generally the same size, shape and configuration; and wherein the first portion of the frame and the second portion of the frame have an inverted position relative to a lower surface of the table top to allow the engaging portion to be disposed in the receiving portion when the frame is in the folded position.

11. The folding table as in claim 5, wherein the frame in the folded position has a height that is at least ten percent less than a height of the first portion of the frame and the second portion of the frame.

12. The folding table as in claim 5, wherein the frame in the folded position has a height that is about twenty percent less than a height of the first portion of the frame and the second portion of the frame.

13. The folding table as in claim 5, wherein the engaging portion is at least substantially disposed in the receiving portion when the frame is in the folded position.

14. The folding table as in claim 5, wherein the engaging portion and the receiving portion are generally aligned and coplanar when the frame is in the folded position and the unfolded position.

15. The folding table as in claim 5, wherein the frame rotates about an axis of rotation between the folded and unfolded positions, the axis of rotation being disposed between an upper surface of the engaging portion and a lower surface of the receiving portion when the frame is in the folded position.

16. The folding table as in claim 5, wherein the frame rotates about an axis of rotation between the folded and unfolded positions, the axis of rotation being disposed between a body of the first portion of the frame and a body of the second portion of frame when the frame is in the folded position.

17. The folding table as in claim 5, wherein the frame rotates about an axis of rotation between the folded and unfolded positions, the axis of rotation being disposed below an outermost portion of the first portion of the frame and an outermost portion of the second portion of the frame when the frame is in the folded position.

18. The folding table as in claim 5, further comprising a receiving portion of the first portion of the frame and an engaging portion of the second portion of the frame, the engaging portion of the second portion of the frame being disposed in the receiving portion of the first portion of the frame when the frame is in the folded position, the engaging portion of the second portion of the frame being spaced apart from the receiving portion of the first portion of the frame when the frame is in the unfolded position.

19. The folding table as in claim 5, wherein the first portion of the frame has a generally L-shaped configuration and the second portion of the frame has a generally L-shaped configuration;

wherein the generally L-shaped first and second portions of the frame nest together when the frame is in the folded position.

20. A frame for a folding table top, the folding table top movable between a folded position in which a first portion of the table top is disposed generally adjacent and parallel to a second portion of the table top and an unfolded position in which the first portion and the second portion of the table top are generally aligned in the same plane, the frame for the folding table top comprising:

a first portion including an elongated body and an engaging portion extending outwardly from the body;

a second portion including an elongated body and a receiving portion, the first portion and the second portion of the frame at least substantially disposed in the same plane, the first and second portions of the frame including an unfolded position in which the first portion and the second portion of the frame are generally aligned along an axis and the engaging portion is spaced apart from the receiving portion, the first and second portions of the frame including a folded position in which the engaging portion is at least partially disposed in the receiving portion; and a hinge assembly pivotally connecting the first portion and the second portion of the frame.

* * * * *

UNITED STATES PATENT AND TRADEMARK OFFICE

CERTIFICATE OF CORRECTION

PATENT NO. : 8,555,789 B2
APPLICATION NO. : 13/559062
DATED : October 15, 2013
INVENTOR(S) : Jin et al.

It is certified that error appears in the above-identified patent and that said Letters Patent is hereby corrected as shown below:

In the Specification

In Column 9, Line 19, delete "first and section" and insert -- first and second --, therefor.

Signed and Sealed this
Twenty-sixth Day of November, 2013

Margaret A. Focarino

Margaret A. Focarino
*Commissioner for Patents of the United States Patent and Trademark Office*